United States Patent [19]

Guglielmo

[11] 4,040,548

[45] Aug. 9, 1977

[54] FLEXIBLE BACK PACK FRAME

[76] Inventor: Joe H. Guglielmo, 340 Pinal St., Globe, Ariz. 85501

[21] Appl. No.: 667,636

[22] Filed: Mar. 17, 1976

[51] Int. Cl.[2] ..... A45F 3/00

[52] U.S. Cl. ..... 224/25 A; 224/8 R

[58] Field of Search ..... 224/25 A, 8 R, 5 W, 224/5 V

[56] References Cited

U.S. PATENT DOCUMENTS

| | | | |
|---|---|---|---|
| 2,421,244 | 5/1947 | Daiber | 224/25 A |
| 3,114,486 | 12/1963 | Flexman | 224/8 R |
| 3,860,157 | 1/1975 | Richards et al. | 224/25 A X |
| 3,902,640 | 9/1975 | Geiben | 224/5 W X |

FOREIGN PATENT DOCUMENTS

| | | | |
|---|---|---|---|
| 844,388 | 8/1960 | United Kingdom | 224/25 A |

*Primary Examiner*—Robert J. Spar
*Assistant Examiner*—Carl Rowold
*Attorney, Agent, or Firm*—Cahill, Sutton & Thomas

[57] ABSTRACT

A frame for a back pack having lateral, parallel upright fiberglass laminate braces curved to conform to the wearer's back and having a flat undersurface, the braces being sufficiently flexible to move conformably to the back in response to changes in the wearer's position. Additional cross and diagonal pieces are provided having curvatures conformable with adjacent portions of the wearer's back.

2 Claims, 3 Drawing Figures

FLEXIBLE BACK PACK FRAME

This invention relates to a back pack frame. The sport of back packing has gained increasing popularity with people of all ages and sizes. As more and more remote regions are sought, the need for strong, reliable and comfortable equipment increases. Back pack frames of many designs and materials have been utilized to achieve these goals. Most materials represent a compromise between weight and strength.

Hollow, tubular aluminum is commonly employed in many high quality pack frames. Generally, the various sections of the frame are joined by welding. The resultant structure is rigid and unyielding. The frame remains essentially stationary regardless of the wearer's position or movement. Accordingly, the load carried by the wearer shifts rather than retains its relative position to the wearer's body. Moreover, since the members of the frame arerigid, they are unyielding and thus uncomfortable to the body when it contacts the frame in the course of body movement.

It is an object of this invention to provide a strong, lightweight back pack frame.

It is another object to provide a strong, lightweight back pack frame having flexible frame members which allow the frame to conformingly yield to the wearer's movement.

These and other objects are provided by the present invention, which comprises a frame for a back pack comprising a pair of parallel, upright members, each having a first portion having a concave curvature adapted to be conformingly positioned along the lateral upper back and a second portion having a convex curvature adapted to be positioned along the lateral lower back, said members comprising a laminate having a first ply of flat fiberglass adapted to be positioned adjacent said back, a filler ply of a material bondable to said fiberglass ply and a second ply of fiberglass, said plys of fiberglass being bonded to opposing faces of said filler ply, said laminate having a flexure such that said upright members flex into conforming relationship with the wearer's back in response to the wearer's movement.

Figure 1:
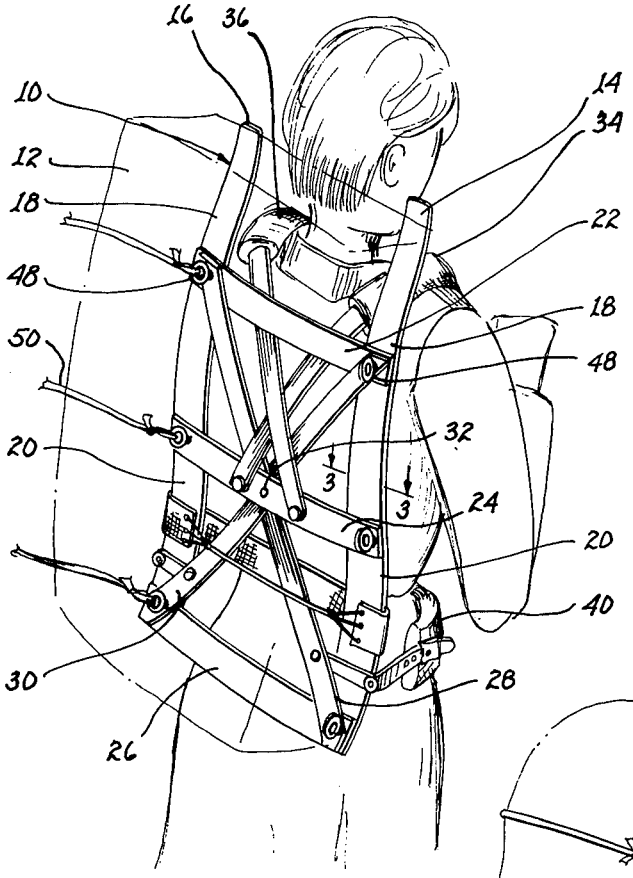
FIG. 1 is a perspective view of the pack frame of the present invention in use.
Figure 3:
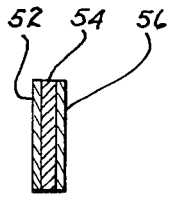
FIG. 3 is a cross-sectional elevational view of the upright frame member of the pack frame.

In FIG. 1, the pack frame 10 carries a pack 12 attached thereto in a conventional manner. Pack frame 10 has two identical upright parallel frame member 14 and 16. Frame members 14 and 16 each have a gradual S curve shape with an upper portion 18 conforming to the lateral upper back of the wearer and a lower portion 20 conforming to the lateral, lower back of the wearer. Between frame members 14 and 16 are three traverse members 22, 24 and 26 bonded to outside faces 28 and 30 of members 14 and 16, respectively. Transverse members 22, 24 and 26 each have a curvature conforming to the adjacent portion of the body, member 22 to the lateral curvature of the upper back, member 24 to the lateral curvature of the midback slightly above the waist, and member 26 to the lateral curvature of the lower back or hip region. Extending diagonally from the junction of upright member 16 and upper transverse member 22 is diagonal member 28. A similar diagonal member 30 extends from the junction of members 16 and 26 to the junction of members 14 and 22. The ends of diagonal members 28 and 30 attach at the outside of the frame, i.e., the side away from the wearer's back. Diagonal members 28 and 30 have curvatures conforming to the diagonal curvature of the wearer's back. At the intersection of diagonal members 28 and 30, they are attached to the underside of transverse member 24 by a pin 32.

The pack frame 10 carries a conventional complement of straps and the like for attachment to the wearer's body. Shoulder straps 34 and 36 attach to transverse member 24 and extend over the shoulder. The shoulder straps 34 and 36 terminate in a D-ring which is attached by a clip to straps 40 and 42, respectively. The latter are attached to the lower portions of upright members 14 and 16. A conventional back band 44 is provided as is a conventional padded waist band 46.

The frame 10 may be fitted with a number of eyelets 48 from which ropes 50 can be tied to hold the bundle or load to be carried, or a conventional back pack may be attached to the frame in the conventional manner.

Figure 2:
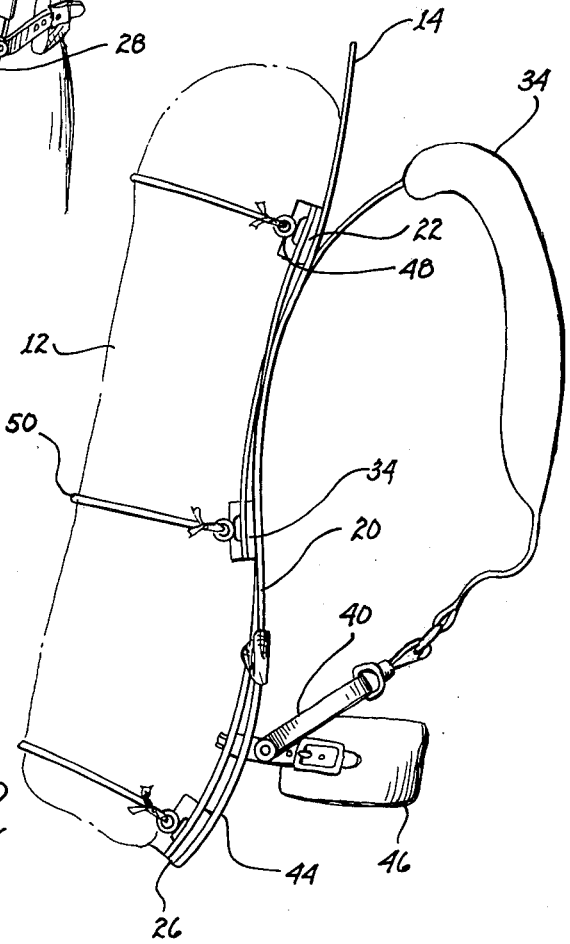
FIG. 2 is a side elevational view of the pack frame of the invention.

The curvature of the various structural members of which the frame 10 is composed are best seen in FIG. 2. Upright members 14 and 16 have an overall S curvature; upper portion 18 being concave and conforming to the upper, lateral portion of the back in a longitudinal direction. The lower portion 20 of upright members 14 and 16 is convex; conforming to the lower, lateral portion of the back in a longitudinal direction.

The upright members 14 and 16 are laminates having a first ply 52, a second ply 54, and a third ply 56. Plys 52 and 56 are flat fiberglass sheets of the type employed in making fiberglass laminate bows. A thickness of 0.050 inches (0.13 cm.) for the fiberglass plys has been found suitable. Thicknesses between 0.25 inches (0.06 cm.) and 0.75 inches (0.18 cm.) may also be employed provided that they are capable of flexing. Suitable fiberglass plys may be obtained from Gordon Plastics, Inc. A perferred material for the fiberglass plys sold under the trade name Bo-Tuff has 100 percent longitudinal fiberglass with sufficient lateral fiberglass reinforcement to prevent splitting, a minimum flexural strength of 200,000 p.s.i., a modulus of elasticity of 5 to 5.5 $\times$ $10^6$, a glass content between 68 and 72 percent by weight, and a width between 1.5 to 2 inches (3.2 – 5 cm.).

Transverse pieces 22, 24 and 26 are two ply laminates, a first ply of the same material as intermediate ply 54 and a second ply of fiberglass preferably having the specifications of plys 52 and 56. Transverse pieces 22, 24 and 26 may be adhesively bonded between the first ply made of wood or other fiberglass bondable material and fiberglass ply 56 of upright members 14 and 16. Diagonal members 28 and 30 may be single plys of fiberglass preferably having the characteristics of ply 52. Diagonal members are preferably bolted to the frame since a good fiberglass/fiberglass adhesive bond is difficult to achieve.

The pack frames of this invention may be mass produced or custom-made. The latter approach insures a more conforming fit. In either case, molds with conforming curvatures are prepared and the materials to be shaped are inserted between the matching molds. Adhesive has previously been placed between the plys to be bonded. The molds are then clamped together and the adhesive allowed to set or cure depending upon its characteristics whereby the members being bonded and assuming their desired curved configurations.

The pack frame of this invention is capable of flexing in response to forces generated by body movement when the pack is appropriately strapped to the wearer's back. Flexure occurs primarily in a forward and backward direction transverse to the upright members 14 and 16. It is important that the upright members 14 and 16 be sufficiently thin so as to be flexible. The use of an intermediate ply 54 of about 0.5 inches (1.2 cm.) with fiberglass plys of 0.05 inches (0.13 cm.) has proved too stiff to attain the desired flexure characteristics.

What is claimed is:

1. A flexible, laminated back pack frame conforming to the dual curvature of a wearer's back for supporting and distributing a load over the wearer's back and shoulder region while simultaneously accomodating movement of the wearer by readily deforming to fit the changing contour of the wearer's back in response to both bending and twisting movements of his body, said frame comprising in combination:

a. a pair of parallel, upright laminated members each having an outwardly curved upper section conformingly fitted to the upper portion of the wearer's back and shoulder region, and an inwardly curved lower portion conformingly fitted to the lower position of the wearer's back, said upright members comprising a laminate having a first ply of glass reinforced plastic positioned adjacent the wearer's back, a second ply of glass reinforced plastic and a wooden filler ply of glass reinforcedplastic and a wooden filler ply situated between and bonded to said glass reinforced plastic plys, said laminate being continuously flexible into a conforming relationship with the wearer's back in response to body movements;

b. upper, central, and lower laminated horizontal crosspieces, each individually bonded to and spanning said upright members, said crosspieces having a curvature conforming to the lateral curvature of the wearer's back at the respective locations of each of said crosspieces; and c. first and second diagonal brace members extending diagonally between said upright members, said diagonal brace members intersecting at a position adjacent the middle of said second crosspiece and having a curvature conforming to the adjacent curvature of the wearer's back; whereby the back pack frame readily and continuously conforms to the contour of the wearer's back in response to both bending and twisting motions of his body and thereby distributes the load over the wearer's back and shoulder region.

2. The back pack frame according to claim 1 wherein said upper, said central, and said lower crosspieces comprise a laminate having a first ply of wood and a second ply of glass reinforced plastic, said laminate being continuously flexible into a conforming relationship with the wearer's back in response to body movements.

* * * * *